US008253637B2

(12) United States Patent
Hoedl et al.

(10) Patent No.: US 8,253,637 B2
(45) Date of Patent: Aug. 28, 2012

(54) ANTENNA ARRAY FOR A MOTOR VEHICLE

(75) Inventors: Johannes Hoedl, Munich (DE); Wilhelm Probst, Bockenem-Stoery (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 105 days.

(21) Appl. No.: 12/825,891

(22) Filed: Jun. 29, 2010

(65) Prior Publication Data

US 2010/0265144 A1 Oct. 21, 2010

Related U.S. Application Data

(63) Continuation of application No. PCT/EP2009/001003, filed on Feb. 13, 2009.

(30) Foreign Application Priority Data

Feb. 26, 2008 (DE) ..... 10 2008 011 131

(51) Int. Cl.
*H01Q 1/32* (2006.01)

(52) U.S. Cl. ..... 343/713; 343/704; 343/711

(58) Field of Classification Search ..... 343/704, 343/711, 713
See application file for complete search history.

(56) References Cited

U.S. PATENT DOCUMENTS

| | | | | |
|---|---|---|---|---|
| 5,548,298 | A | 8/1996 | Nakase | |
| 5,581,263 | A | 12/1996 | Maeda et al. | |
| 6,121,934 | A * | 9/2000 | Taniguchi et al. | 343/713 |
| 6,184,837 | B1 | 2/2001 | Lindenmeier et al. | |
| 6,215,450 | B1 * | 4/2001 | Oka | 343/713 |
| 7,616,162 | B2 | 11/2009 | Hoffmeister | |
| 7,719,475 | B2 * | 5/2010 | Kuehne | 343/713 |
| 2008/0055169 | A1 | 3/2008 | Kuehne | |

FOREIGN PATENT DOCUMENTS

| | | | |
|---|---|---|---|
| DE | 198 54 169 | A1 | 5/2000 |
| DE | 102 34 851 | A1 | 2/2004 |
| DE | 103 50 780 | A1 | 6/2005 |
| DE | 20 2006 016 3 | | 4/2007 |
| JP | 2001-308624 | A | 11/2001 |
| JP | 2001-320293 | A | 11/2001 |
| WO | WO 2005/060044 | A1 | 6/2005 |

OTHER PUBLICATIONS

German Search Report dated Feb. 3, 2009 with partial English translation (nine (9) pages).

International Search Report dated Apr. 17, 2009 with English translation (six (6) pages).

* cited by examiner

*Primary Examiner* — Tan Ho

(74) *Attorney, Agent, or Firm* — Crowell & Moring LLP

(57) ABSTRACT

An antenna array for a motor vehicle includes at least one AM antenna for receiving long wave, medium wave and/or short wave signals as well as at least one additional electrically conductive structural part that is arranged so as to be adjacent to the AM antenna. The additional structural part is connected to a ground potential and/or supply potential of the motor vehicle by at least one filter element, by which the signal frequencies in at least one frequency range that is to be received by the AM antenna are suppressed.

20 Claims, 4 Drawing Sheets

ANTENNA ARRAY FOR A MOTOR VEHICLE

CROSS-REFERENCE TO RELATED APPLICATIONS

This application is a continuation of PCT International Application No. PCT/EP2009/001003, filed Feb. 13, 2009, which claims priority under 35 U.S.C. §119 from German Patent Application No. DE 10 2008 011 131.7, filed Feb. 26, 2008, the entire disclosures of which are herein expressly incorporated by reference.

BACKGROUND AND SUMMARY OF THE INVENTION

The invention relates to an antenna array for a motor vehicle.

Modern motor vehicles typically have at least one antenna, often even a plurality of antennas and optionally even different types of antennas, in order to be able to use, for example, radio and TV services in motor vehicles. Usually the configuration of the antennas endeavors to reach the best possible compromise between the antenna efficiency, the electromagnetic compatibility with respect to the vehicle's own interfering components and the design of the vehicle. For example, in modern motor vehicles the antennas are often integrated into the rear window, in one of the rear side windows or in the spoiler.

In this context an antenna array that is totally or partially integrated into such a part of the vehicle, for example, the rear window, can include a number of antennas. It can also include additional elements for the antenna(s), for example, connecting elements, amplifiers, filters and/or signal processing units (for example, antenna diversity module). The antenna array can also include structural parts that primarily do not fulfill any antenna function, for example, a rear car window heating system.

However, it is frequently the case that the heating lines of a rear car window heating system also fulfill, besides their heating function, an antenna function. For such heating lines it is known, for example, from WO 2005/060044 A1 to suppress the interference from the vehicle electrical system that is transmitted by the heating current to the heating conductors acting as the antenna by use of modules having a high impedance behavior at high frequencies (so-called blocking circuits or blocking circuit filters), when the antenna connecting point is electrically connected to the heating field. Moreover, it is also possible to suppress in this way, as also applied in the vehicles of the assignee, that the useful currents of the antennas leak off to the supply potential of the power supply and/or to the ground potential.

Working on this basis, the object of the invention is to improve the antenna reception of AM antennas installed in motor vehicles.

This object is achieved by an antenna array for a motor vehicle, the antenna array having at least one AM antenna for receiving at least long wave, medium wave and/or short wave signals, as well as at least one additional electrically conductive structural part that is arranged so as to be adjacent to the AM antenna. The additional structural part is connected to a ground potential and/or supply potential of the motor vehicle by at least one filter element, by which signal frequencies in at least one frequency range that is to be received by the AM antenna are suppressed. Advantageous embodiments and further developments of the invention are described herein.

The invention improves the reception properties of the AM antenna in the long wave, medium wave and/or short wave range. Surprisingly, this technological success is not the result of filter designs that are based directly on the AM antenna itself, but rather on filter designs that are based on an adjacent structural part or component.

Similarly, the invention makes it possible to vary in a targeted manner the characteristic reception properties of the AM antenna in the long wave, medium wave and/or short wave range. For example, it is possible to achieve a gain as a function of the angle of incidence.

In this context, it is contemplated to switch on and/or off an antenna or, very loosely generalized, to vary in a targeted manner its characteristic by shielding an adjacent part.

The AM antennas in the antenna arrays according to the prior art exhibit suboptimal properties with respect to the specific market and/or customer demands. For example, it is usually very important for the North American market that the sound quality of the radio reception be very good in the medium wave range. However, this customer expectation cannot always be fulfilled to the customer's satisfaction with the above described compromise between antenna efficiency, electromagnetic compatibility and vehicle design. This situation applies in particular to regions where the strength of the transmission signal is weak (for example, in rural areas). In that case the physical nature, in particular, the length of the AM antenna that is integrated into the rear car window, the side window or the spoiler, is often inadequate for receiving medium waves.

Moreover, adverse external conditions can make the reception of medium waves problematic and/or reduce its quality. In many cases the motor vehicle does not even have the aforementioned customary installation sites. Similarly, conventional antenna arrays may not be able to satisfy the special market demands on the antenna performance, for example, with unusual frequency bands, field strengths or varying broadcasting station and/or geographical topology.

The invention is especially appropriate for use with AM antennas having a length that is very much smaller than the wavelength of the signals received, because it is precisely in such AM antennas in the conventional antenna array that the aforementioned suboptimal properties and/or drawbacks can occur most often.

The invention is based on the consideration that the reception properties of the AM antenna can be improved by influencing the metallic or otherwise electrically conductive structural parts, which are directly and/or electrically connected at low impedance to the electrical vehicle body and are arranged so as to be adjacent to the AM antenna, in such a manner that the electrical vehicle body, as the ground potential, is no longer "visible" to the AM antenna. In this context, a conductive element is "visible" when it acts on the antenna as a parasitic capacitance. Such parasitic capacitances attenuate the supply of the antenna signal power to the next step of the signal chain, which is often designed as an amplifier. The invention prevents such an attenuation.

In principle, the vehicle body of a structural part adjacent to the AM antenna can be made "invisible" to the AM antenna in an especially easy way by making the adjacent structural part of an electrically non-conductive material, provided that such a design would not impair its function. Similarly, the adjacent structural part can be electrically insulated from the vehicle body, provided that such a measure would not impair its function.

However, the invention provides a targeted shielding of the adjacent structural part for the frequency range to be received by the AM antenna. As a result, the adjacent vehicle body is made invisible in a selective way for such frequencies.

Optionally the structural part can be shielded simultaneously against all higher frequencies. Then a low pass filter can be used as the filter element.

The invention can be applied in an especially advantageous way to antenna arrays, in which the heating wires of a rear car window heating system run at least partially in the immediate proximity of the AM antenna. In such cases the improvement in the AM reception that the invention achieves is especially apparent.

Similarly, the invention can be applied advantageously to antenna arrays, in which an additional antenna, for example, an FM and/or TV antenna, is arranged at least partially in the immediate proximity of the AM antenna as an additional structural part in the context of the invention. For example, both antennas can be mounted on the same rear car window. Even in such cases the invention affords a significant improvement in the AM reception.

In order to enhance the effect of the invention, additionally existing low impedance or capacitance ground paths can be eliminated and/or minimized.

This purpose can be achieved, on the one hand, by disposing the structural part, which is shielded according to the invention, at a long geometric distance from the parts, lines or other structural parts that are connected to the ground potential. On the other hand, this purpose can also be achieved by a targeted low impedance and low capacitance design of the additional terminals of the shielded structural part and/or by a targeted low impedance and low capacitance design of the optionally necessary matching circuits of the structural part.

As described above, the additional structural part can be designed as an additional antenna. Preferably this antenna is connected to the ground potential and/or supply potential of the motor vehicle (additionally to the aforementioned filter element), furthermore by way of at least one additional filter element, by which the signal frequencies in at least one frequency range that is to be received by the additional antenna are suppressed. As a result, it can also be prevented that the useful currents of the additional antenna leak off to the supply potential and/or to the ground potential.

According to a preferred embodiment of the present invention, the antenna array exhibits, besides the aforementioned adjacent structural part, at least one additional electrically conductive component, which is arranged so as to be adjacent to the AM antenna, and the filter element has a bifilar coil (bifilar winding) comprising a first and a second coil section.

At the same time the additional structural part is connected to the ground potential and/or supply potential by the first coil section of the bifilar coil. The additional component is connected to the ground potential and/or supply potential by the second coil section of the bifilar coil. In this context the bifilar coil is defined as a two wire coil that is wound counterclockwise. At the same time each winding wire represents by itself a complete coil, called a coil section herein. When the coil sections are supplied with identical current, the resulting magnetic fields virtually cancel each other out. Therefore, this design makes it possible to suppress the generation of magnetic interference fields.

The additional component, mentioned in the preceding paragraph can also be designed as an antenna, in particular, an FM and/or TV antenna. It can be fitted together with the AM antenna and the additional structural part, which can also be designed as an antenna, in particular, an FM and/or TV antenna, in a rear window of the vehicle.

Especially if the AM antenna, the additional structural part and an additional component (which may or may not be present), of the antenna array are integrated into a rear window of the motor vehicle, it may be advantageous for the at least one filter element, which is used and optionally designed as a bifilar coil, to be mounted on the rear car window shelf or the C post of the motor vehicle.

The invention can be implemented in various ways, some of which have already been addressed and some of which shall be discussed below on the basis of the following embodiments. In addition, other designs for improving the reception quality can be implemented selectively and in stages. In this way a fine scalability is achieved. As a result, the cost per vehicle is recouped only if the corresponding special equipment options are also installed. Hence, a simply equipped vehicle can also be provided with a simple and cost effective antenna system comprising very few parts that have to be installed.

In addition, a reduction in cost can also be achieved by the extensive use of parts that are identical to those used in prior art antenna systems and by the use of standard components. The only requirements for a practical implementation of the invention are minor system interventions and/or new developments.

Furthermore, given a suitable design for all of the country-specific special equipment and for the diverse antenna relevant special equipment options, just a single rear car window is necessary, both with respect to its conductor structure (which can also be used for heating) as well as with respect to the design of its electrical (heating) terminals and antenna taps. This strategy enables cost reductions in the areas of development, logistics and production.

The antenna according to the invention allows for an improvement in the response to customer-specific and market-specific demands. In particular, vehicle users who appreciate high functionality (in particular, good reception power) and who are design sensitive, can be offered a suitable product by way of the invention.

In addition, the invention makes it possible to achieve a reduction in cost, because the functionality of the antenna concept is expanded only selectively in response to the customer and/or market-specific demands and not in general for each product that is produced. The results are advantages, from which production, parts complexity and logistics can also benefit.

Last, but not least, when viewed over the life cycle of a motor vehicle, the invention also increases the flexibility in connection with the varying external conditions of the broadcasting landscape as well as with respect to technical innovations, such as the conversion from analog to digital reception.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1A:
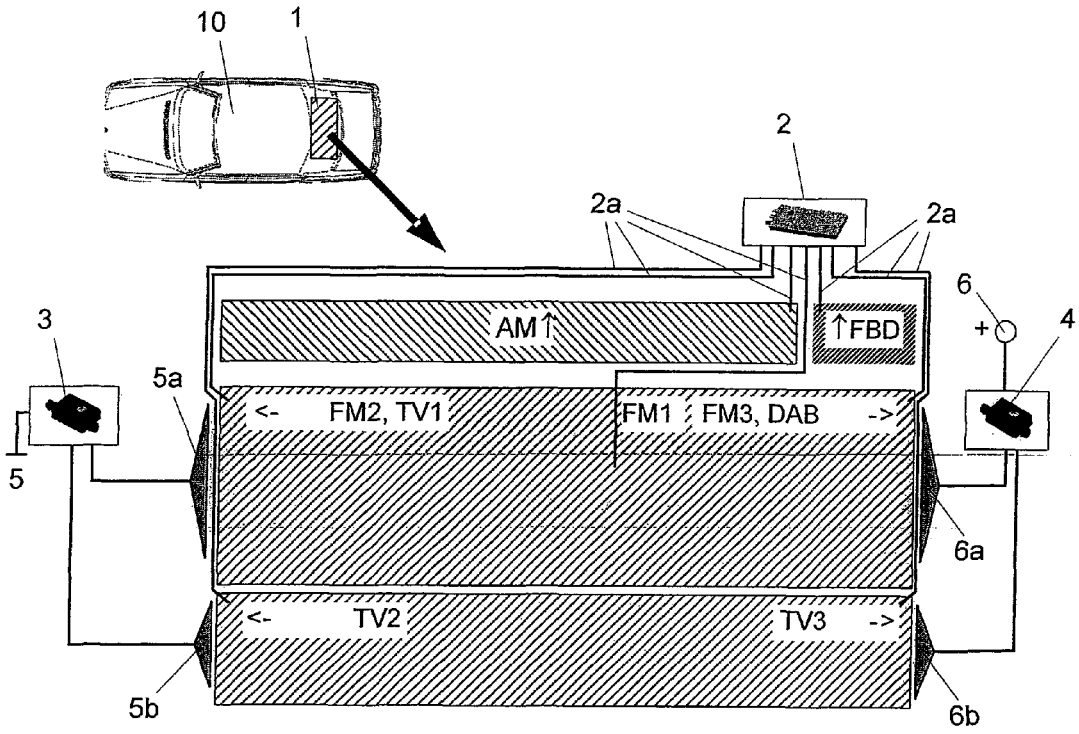
Fig. 1a (BACKGROUND ART)
FIG. 1*a* shows a first antenna array that is partially integrated into a rear car window.

FIG. 1*a* shows an antenna array that is partially integrated into a rear window 1 of a motor vehicle 10. In addition to an AM antenna AM, a number of other antennas are built into the rear car window 1. They are, in total, three FM antennas FM1, FM2 and FM3; three TV antennas TV1, TV2 and TV3; an antenna FBD for remote control services as well as an antenna DAB for digital radio reception. To some extent the antennas have multiple functions, so that even the taps of the antennas are used repeatedly, as a result of which the number of antennas can be reduced. The FM antenna FM2 is physically identical to the TV antenna TV2. The FM antenna FM3 is physically identical to the antenna DAB for digital radio. In addition, the antennas FM1, FM2, FM3, TV2 and TV3 also act as heating wires of a rear car window heating system.

In order to understand the figures it must be pointed out that the antenna ranges overlap in a manner that is known from the prior art (for example, FM1 with FM2, FM1 with FM3 and TV2 with TV3). For this reason the figures do not show any boundaries of the overlapping antennas.

Each antenna is connected by way of a feed line to a signal processing unit 2 that can include, for example, an antenna diversity module and amplifiers.

The antennas FM1, FM2, FM3, TV1, DAB, TV2 and TV3, which also act as the heating wires of a rear car window heating system, are connected and/or can be connected to a supply potential 6 by way of the terminals 6*a* and/or 6*b* and to a ground potential 5 by way of the terminals 5*a* and/or 5*b* for heating purposes. The blocking circuits 3 and 4 between the terminals 5*a*, 5*b*, 6*a*, 6*b* of the antennas and the ground potential 5 and/or the supply potential 6 may suppress any interference from the vehicle electrical system that is transmitted from the heating current to these antennas and may prevent the useful currents of the antennas from leaking off to the ground potential 5 or to the supply potential 6. For the former purpose the signal frequencies in the typical frequency ranges are suppressed in a targeted manner by the vehicle electrical system interference. For the latter purpose either the signal frequencies in the frequency range to be received by the respective FM antenna and/or TV antenna are suppressed in a targeted manner or simply blocked by way of a low pass filter. For FM or TV band 1 frequencies it can be designed, for example, so as to act in an effectively blocking manner for frequencies above 30 MHz.

Figure 1B:
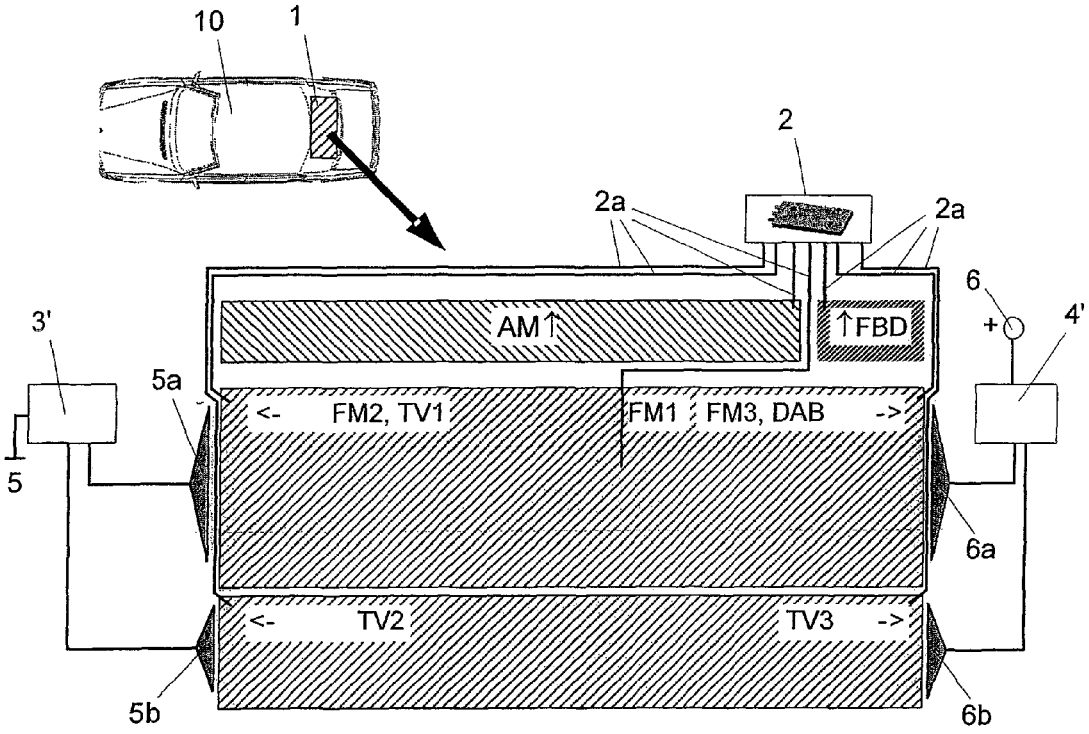
FIG. 1*b* shows a modification of this antenna array.

FIG. 1*b* shows a modified embodiment of the antenna array according to FIG. 1*a*. In this modified embodiment, the blocking circuits 3 and 4 are replaced by the filter elements 3' and 4'. The filter elements 3' and 4' fulfill the aforementioned tasks of the blocking circuits 3 and 4. That is, they suppress the vehicle electrical system interference and suppress the signal frequencies in the frequency range to be received by the respective FM antenna and/or TV antenna. In addition, the filter elements 3' and 4' also make it possible to suppress the signal frequencies in at least one frequency range that is to be received by the adjacent AM antenna AM.

The suppression of the FM/TV frequencies and the suppression of the AM frequencies can be effected by the respective dedicated filter designs inside the filter element 3' and/or 4'. However, it appears to be advantageous to provide a common filter design for the suppression of both the FM/TV frequencies as well as for the suppression of the AM frequencies. For example, a filter element that is designed as a low pass filter can be used to suppress and/or block the frequencies above 400 kHz.

It is possible to improve the AM reception by shielding the AM antenna against the FM/TV frequencies. In that way it is possible to prevent the FM and/or TV antennas that are adjacent to the AM antenna from acting as parasitic capacitances. Even the penetration of parasitic frequencies from the outside is prevented in the shielded frequency spectrum.

Instead of the comprehensive shielding of all of the antennas FM1, FM2, FM3, TV2 and TV3, it is also possible to shield in a selective manner only a portion thereof, in particular, the portion that lies geometrically the closest to the AM antenna. This design also affords an improvement in the AM reception. In the extreme case it is also possible to shield, if desired, just a single heating conductor, that is, the one lying the closest to the AM antenna. In practice, the case of shielding a few less heating conductors, which lie the closest to the AM antenna, appears to be especially relevant.

In contrast to the example under discussion, it is also possible in principle to shield the adjacent FM/TV antennas by suppressing exclusively the signal frequencies in at least one frequency range to be received by the adjacent AM antenna AM, that is, without simultaneously suppressing the signal frequencies in the frequency range to be received by the respective FM antenna and/or TV antenna and/or without filtering the typical frequency ranges from the vehicle electrical system interferences.

Figure 2:
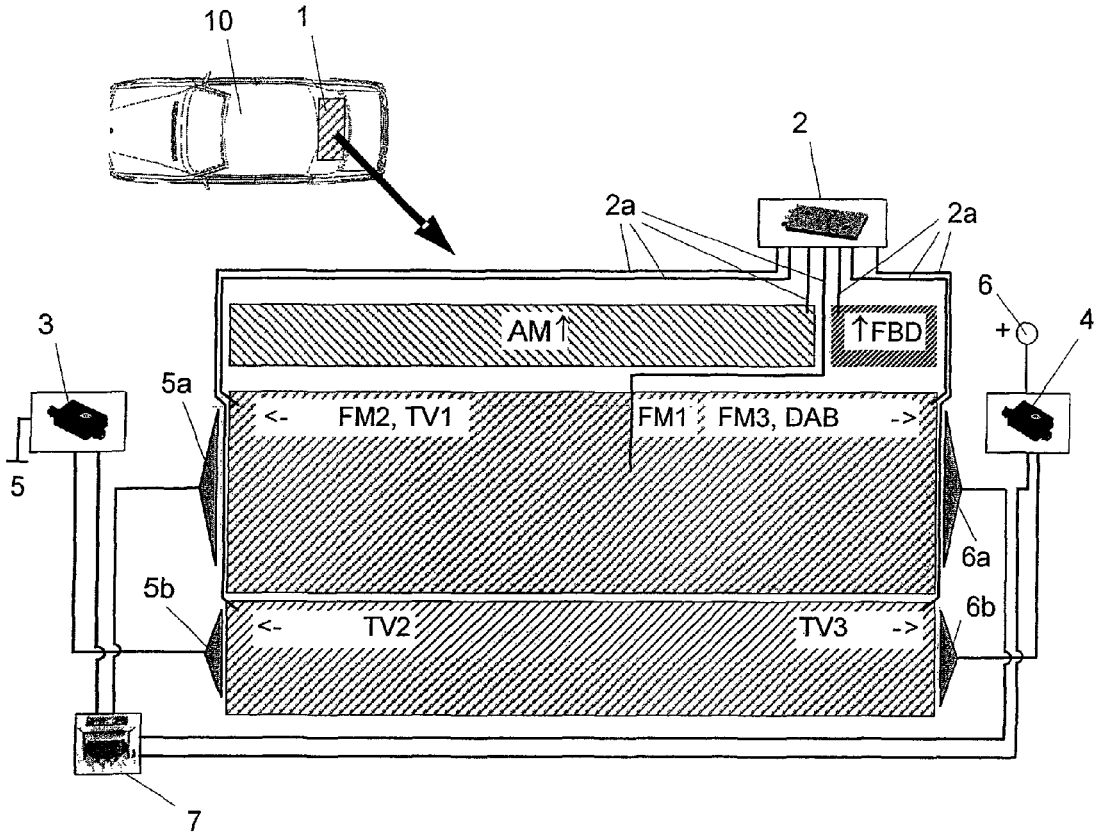
FIG. 2 shows a second antenna array that is partially integrated into a rear car window.

FIG. 2 shows a second antenna array that is partially integrated into a rear car window. It matches in essence the antenna array from FIG. 1*a* so that it is not discussed in detail below. However, in this case the shielding of the antennas FM1, FM2 and FM3 for the purpose of suppressing the signal frequencies in at least one frequency range to be received by the adjacent AM antenna AM takes place by way of a bifilar wound coil 7. The bifilar wound coil 7 can achieve by itself a filtering effect or optionally even in combination with capacitors (for example Lo ESR [low equivalence series resistance] types), from which feature the goal of an enhanced reception performance can benefit.

Thus, a first variant provides that the bifilar coil 7 can effect, independently of the effect of the blocking circuits 3 and 4, a blockage of both the AM frequencies and also the FM/TV frequencies. Then the ground-sided terminal of the respective coil section of the bifilar coil 7 can be connected directly to the vehicle body or be run to the blocking circuit 3 and/or 4 (according to the case depicted in FIG. 2), where, however, they are only looped through on the vehicle body.

According to a second variant, the bifilar coil 7 can be designed in such a manner that the desired filtering effect is produced only in interaction with the blocking circuit 3. Then the effect of the bifilar coil 7 is limited to the AM filtering, while the FM/TV filtering is executed by the blocking circuit 3 and/or 4 in a manner that is known from the prior art.

Since this second variant provides a concentration of the AM filtering on the bifilar coil 7 as the dedicated structural part, it is possible to provide in a selective way the AM filtering by selectively integrating the bifilar coil. Therefore, the AM filtering can be provided, for example, according to a specific market or region or according to the explicit request of the buyer of an automobile. In addition, this second variant supports the modular construction principle that is targeted in the development and design of automobiles for reasons relating to cost and efficiency.

In addition to the use of blocking circuits and/or a bifilar coil, the invention may also be implemented with other forms of filtering.

Given a suitable design, it would also be advantageous to imprint the necessary filter elements or at least a portion thereof directly on the window pane.

In addition to the described filter designs, the area that is adjacent to the actual AM antenna and that is shielded according to the invention can also be separated elsewhere by additional ground paths. In the specific case this measure can be implemented by, on the one hand, an arrangement of the shielded heating field and/or the shielded FM/TV antenna at a great geometric distance from the parts, the lines or the windshield integrated lines that are connected to the ground potential; on the other hand, targeted high impedance and low capacitance execution of the additional terminals of the shielded heating field, the shielded FM/TV antenna, the matching circuits of the shielded heating field and/or the shielded FM/TV antenna.

For example, such matching circuits for additional antenna taps can be configured by a series capacitance that is as small as possible. Similarly the input matching of a possible antenna amplifier can be executed in such a targeted manner that its series capacitance is kept small. As an alternative or in addition, the heating lines can be run over a coil having a large inductance in the vicinity of the window pane or on the window pane so that its (parasitic) capacitance against ground at the amplifier input is minimized.

Figure 3:
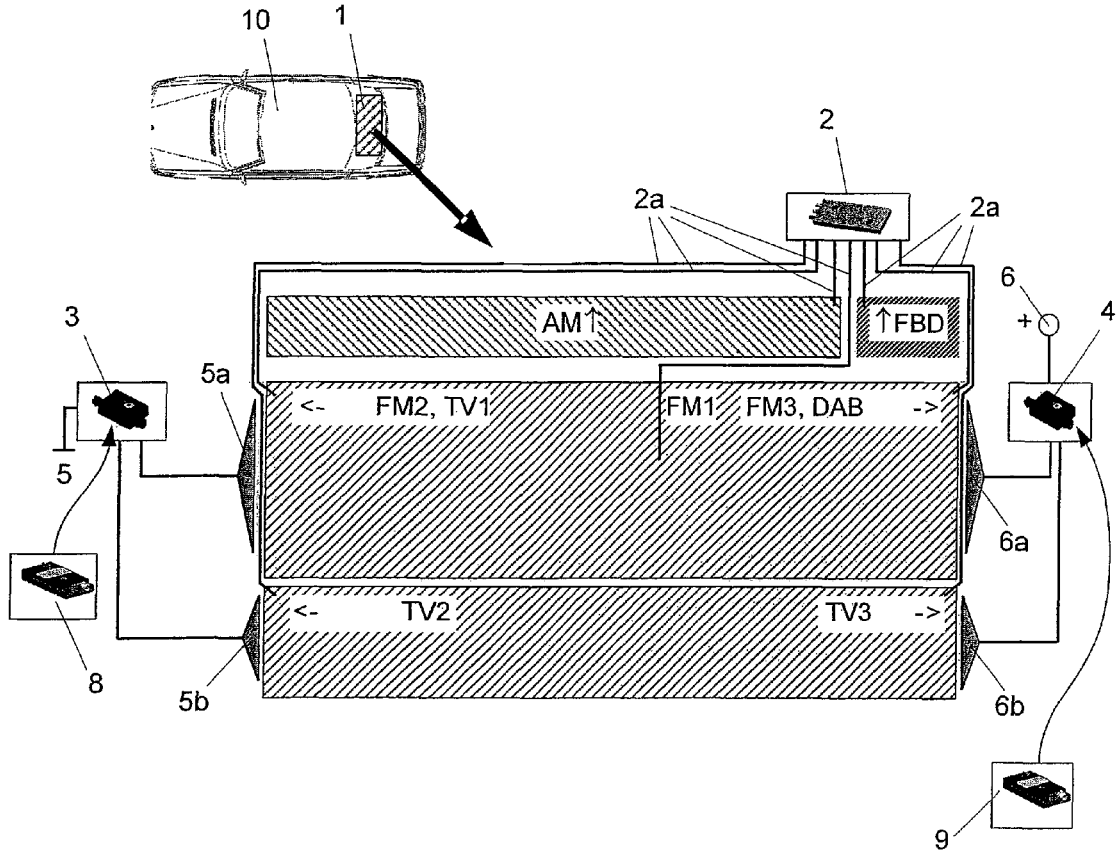
FIG. 3 shows a third antenna array that is partially integrated into a rear car window.

FIG. 3 shows an additional antenna array that is partially integrated into a rear car window. It matches in essence the antenna array from FIG. 1*a* so that it is not discussed in detail below. However, the antenna array according to FIG. 3 includes the antenna amplifiers 8 and 9 for the TV antennas TV2 and TV3.

In this context the antenna amplifier 8 is integrated into the housing of the blocking circuit 3; the antenna amplifier 9 is integrated into the housing of the blocking circuit 4. Therefore, during the assembly of the vehicle fewer individual parts have to be installed despite the use of multiple and distributed taps and antenna amplifiers (for example, for multiple reception services as the special equipment, like TV). The result of this feature and other synergies is a reduction in cost. The antenna amplifiers 8,9 can be easily replaced, as desired, and/or are easy to provide, on request. This feature, too, takes into consideration the aforementioned modular construction idea. In addition, this feature demands altogether less design space in the side parts of the motor vehicle.

The integration of the antenna amplifiers 8,9 into the blocking circuit housing can be carried out independently of the shielding of the antennas adjacent to the AM field with respect to the signal frequencies in the frequency range to be received by the AM antenna, when a blocking circuit is already provided for shielding the FM antennas with respect to the signal frequencies in the frequency range to be received by the FM antenna and/or with respect to the vehicle electrical system interference.

In principle, the inventive idea that is presented here for the especially advantageous use in an AM antenna can also be applied to other types of antennas with a specific reception range. In this context it would be advantageous for reasons, which are in conformity in essence with the above argument, to provide an antenna array for a motor vehicle, exhibiting at least one antenna for receiving signals in a specific frequency range as well as at least one additional electrically conductive structural part, which is arranged so as to be adjacent to the antenna, wherein the additional structural part is connected to a ground potential and/or supply potential of the motor vehicle by at least one filter element, by which signal frequencies in the specific frequency range are suppressed in a targeted and/or selective manner.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An antenna array for a motor vehicle, comprising:

at least one AM antenna for receiving at least one of long wave, medium wave and short wave signals;

at least one additional electrically conductive structural part arranged adjacent to, and electrically de-coupled from, the AM antenna;

at least one filter element, by which the additional electrically conductive structural part is coupled to at least one of a ground potential and a supply potential of the motor vehicle, the at least one filter element being operatively configured to suppress signal frequencies in at least one frequency range receivable by the AM antenna, wherein the filter element is electrically de-coupled from the AM antenna.

2. The antenna array according to claim 1, wherein the additional electrically conductive structural part is an additional antenna of the motor vehicle.

3. The antenna array according to claim 2, wherein the additional antenna of the motor vehicle is at least one of an FM, DAB, FBD, and TV antenna.

4. The antenna array according to claim 3, further comprising at least one additional filter element; and wherein the additional antenna is coupled to at least one of the ground potential and the supply potential of the motor vehicle; and wherein the additional filter element is operatively configured to suppress signal frequencies in at least one frequency range receivable by the additional antenna.

5. The antenna array according to claim 3, further comprising at least one additional electrically conductive component arranged adjacent to the AM antenna;

wherein the filter element is a bifilar coil comprising a first and a second coil section;

wherein the additional electrically conductive structural part is connected to at least one of the ground potential and the supply potential by the first coil section of the bifilar coil; and wherein the additional electrically conductive component is coupled to at least one of the ground potential and the supply potential by the second coil section of the bifilar coil.

6. The antenna array according to claim 2, further comprising at least one additional filter element; and wherein the additional antenna is coupled to at least one of the ground potential and the supply potential of the motor vehicle; and wherein the additional filter element is operatively configured to suppress signal frequencies in at least one frequency range receivable by the additional antenna.

7. The antenna array according to claim 6, further comprising a rear window of the motor vehicle, the AM antenna and the additional electrically conductive structural part being disposed in the rear window of the motor vehicle.

8. The antenna array according to claim 2, further comprising at least one additional electrically conductive component arranged adjacent to the AM antenna;

wherein the filter element is a bifilar coil comprising a first and a second coil section;

wherein the additional electrically conductive structural part is connected to at least one of the ground potential and the supply potential by the first coil section of the bifilar coil; and wherein the additional electrically conductive component is coupled to at least one of the ground potential and the supply potential by the second coil section of the bifilar coil.

9. The antenna array according to claim 2, further comprising a rear window of the motor vehicle, the AM antenna and the additional electrically conductive structural part being disposed in the rear window of the motor vehicle.

10. The antenna array according to claim 9, wherein the additional electrically conductive structural part is operatively configured as a heating wire of a rear car window heating system.

11. The antenna array according to claim 1, further comprising at least one additional electrically conductive component arranged adjacent to the AM antenna;

wherein the filter element is a bifilar coil comprising a first and a second coil section;

wherein the additional electrically conductive structural part is connected to at least one of the ground potential and the supply potential by the first coil section of the bifilar coil; and wherein the additional electrically conductive component is coupled to at least one of the ground potential and the supply potential by the second coil section of the bifilar coil.

12. The antenna array according to claim 11, wherein the additional electrically conductive component is an antenna.

13. The antenna array according to claim 12, further comprising a rear window of the motor vehicle, the AM antenna, the additional electrically conductive structural part and the additional electrically conductive component being disposed in the rear window of the motor vehicle.

14. The antenna array according to claim 13, wherein the additional electrically conductive structural part is operatively configured as a heating wire of a rear car window heating system.

15. The antenna array according to claim 11, wherein the additional electrically conductive component is at least one of an FM, DAB, FBD, and TV antenna.

16. The antenna array according to claim 15, further comprising a rear window of the motor vehicle, the AM antenna, the additional electrically conductive structural part and the additional electrically conductive component being disposed in the rear window of the motor vehicle.

17. The antenna array according to claim 11, further comprising a rear window of the motor vehicle, the AM antenna, the additional electrically conductive structural part and the additional electrically conductive component being disposed in the rear window of the motor vehicle.

18. The antenna array according to claim 17, wherein the additional electrically conductive structural part is operatively configured as a heating wire of a rear car window heating system.

19. The antenna array according to claim 1, further comprising a rear window of the motor vehicle, the AM antenna and the additional electrically conductive structural part being disposed in the rear window of the motor vehicle.

20. The antenna array according to claim 19, wherein the additional electrically conductive structural part is operatively configured as a heating wire of a rear car window heating system.

* * * * *